US011089659B2

(12) United States Patent
Lee et al.

(10) Patent No.: US 11,089,659 B2
(45) Date of Patent: Aug. 10, 2021

(54) PLANAR HEATING ELEMENT

(71) Applicant: CHANGMIN TECHRON CO., LTD, Gyeongsangnam-do (KR)

(72) Inventors: Yonghee Lee, Changwon-si (KR); Minjae Kim, Changwon-si (KR)

(73) Assignee: CHANGMIN TECHRON CO., LTD, Gyeongsangnam-Do (KR)

( * ) Notice: Subject to any disclaimer, the term of this patent is extended or adjusted under 35 U.S.C. 154(b) by 301 days.

(21) Appl. No.: 15/775,135

(22) PCT Filed: Dec. 2, 2015

(86) PCT No.: PCT/KR2015/013048
§ 371 (c)(1),
(2) Date: May 10, 2018

(87) PCT Pub. No.: WO2017/082452
PCT Pub. Date: May 18, 2017

(65) Prior Publication Data

US 2018/0376538 A1 Dec. 27, 2018

Related U.S. Application Data

(63) Continuation of application No. PCT/KR2015/013048, filed on Dec. 2, 2015.

(30) Foreign Application Priority Data

Nov. 11, 2015 (KR) ..... 10-2015-0158038

(51) Int. Cl.
*H05B 3/06* (2006.01)
*H05B 3/34* (2006.01)
*H05B 3/00* (2006.01)

(52) U.S. Cl.
CPC ..... *H05B 3/34* (2013.01); *H05B 3/0023* (2013.01); *H05B 3/06* (2013.01);
(Continued)

(58) Field of Classification Search
None
See application file for complete search history.

(56) References Cited

U.S. PATENT DOCUMENTS 3,425,020 A * 1/1969 Nishida ..... D03D 1/00 338/208
4,983,814 A * 1/1991 Ohgushi ..... H05B 3/34 219/545
(Continued)

FOREIGN PATENT DOCUMENTS

DE 102014113020 A1 * 3/2016 ..... H05B 3/347
EP 1988748 A 11/2008
(Continued)

OTHER PUBLICATIONS

KR100705462B1, Apr. 2007, Phase Heating Element of Carbon Fiber, Kim, partial translation.*
KR200418965Y1, Jun. 2006, Heating Fabric, partial translation.*

*Primary Examiner* — Joseph M. Pelham
(74) *Attorney, Agent, or Firm* — Paratus Law Group, PLLC

(57) ABSTRACT

The present invention relates to a planar heating element and, more particularly, to planar heating using a multiple electrode system configured to uniformly generate heat by weaving using wires having different thicknesses and materials. In order to achieve the aforementioned objective, a planar heating element of the present invention comprises: a first wire part which is heated to generate heat when power is supplied and which is formed of a mesh structure having a regular size; a second wire part which generates heat when power is supplied and which is formed at a mesh size
(Continued)

relatively larger than the mesh size of the first wire portion; and a module part for supplying power to the first wire part and the second wire part.

4 Claims, 2 Drawing Sheets

(52) U.S. Cl.
CPC .. *H05B 2203/007* (2013.01); *H05B 2203/014* (2013.01); *H05B 2203/016* (2013.01)

(56) References Cited

U.S. PATENT DOCUMENTS 5,484,983 A * 1/1996 Roell ..... D04B 1/12 219/528
6,049,063 A * 4/2000 Barber ..... H05B 3/56 219/213
7,064,299 B2 * 6/2006 Green ..... H05B 3/347 219/515
9,127,381 B2 * 9/2015 Gao ..... D03D 27/06
2001/0002669 A1 6/2001 Kochman
2007/0246456 A1 10/2007 Yoneyama et al.
2008/0290084 A1 * 11/2008 Winscom ..... G03C 5/58 219/522
2009/0051196 A1 2/2009 Ishii et al.
2009/0094821 A1 * 4/2009 Kim ..... H05B 3/347 29/611
2010/0206863 A1 * 8/2010 Ritter ..... D06M 11/74 219/202
2011/0089160 A1 * 4/2011 Kuriki ..... G06F 3/044 219/553
2013/0034343 A1 2/2013 Gilad
2019/0297679 A1 * 9/2019 Gima ..... H05B 3/84
2021/0076459 A1 * 3/2021 Pope ..... H05B 3/34

FOREIGN PATENT DOCUMENTS

KR 200418965 Y1 * 6/2006
KR 100705462 B1 * 4/2007
WO 02/17687 A1 2/2002
WO WO-2017086526 A1 * 5/2017 ..... H05B 3/12

* cited by examiner

PLANAR HEATING ELEMENT

TECHNICAL FIELD

The present invention relates to a planar heating element and, more particularly, to planar heating using an electrode system configured to evenly generate heat by using woven wires which have different thicknesses and materials.

RELATED ART

In general, a planar heating element by means of application of electric current. is easy to control its temperature. That is why such a planar heating element is widely used as a household heating appliance in apartments or houses.

A heating wire, such as a nichrome wire etc., is often used as a heat generating source of a planar heating element. However, when it comes to a planar heating element consisting of a heating wire such as a nichrome wire etc., electricity flows through one line. If any part of the line is cut off, electricity does not flow. Accordingly, the planar heating element does not operate.

Further, as illustrated in FIG. 1, in the case of a planar heating element in which thin wires are woven, when power is supplied, power is not evenly supplied. In this case, the part with high resistance partially is burned out. Although an electrode consisting of a copper plate or a material with high conductivity is installed at the edge and the center of the planar heating element, the planar heating element is burned out when resistance becomes high. This is because thinner wire has higher flexibility but has higher resistance.

DETAILED DESCRIPTION OF THE INVENTION

Technical Problems

Embodiments of the present invention are devised to solve the above-described problems and are directed to providing a planar heating element configured to evenly generate heat by allowing electric current to evenly flow across a whole plane by means of wires having different thicknesses and materials.

Further, embodiments of the present invention is also directed to providing a metal planar heating element with high reliability, which is not overloaded or burned out by means of fine control of electric current.

Technical problems solved by the present invention are not limited to the above-described ones. Further, other technical problems that have not been described above will become apparent to those skilled in the art to which the present invention pertains on the basis of the description that will be provided below.

Technical Solutions

As a means to solve the above-described problems, a planar heating element of the present invention includes a first wire part which generates heat when power is supplied and which has a mesh structure with a regular size; a second wire part that is connected to the first wire part and generates heat when power is supplied and which has a mesh size relatively larger than that of the first wire part; and a module part for supplying power to the first wire part and the second wire part.

Further, the first wire part may be formed from a material with an electric resistance coefficient relatively higher than that of a material of the second wire part.

Further, the first wire part may be formed from stainless steel (STS), and the second wire part may be formed from a conductive material including at least one of STS, copper, nickel.

Further, the first wire part may have a thickness and pattern different from those of the second wire part.

Further, the first wire part and the second wire part may be woven.

Advantageous Effects

A planar heating element according to the present invention has the following advantageous effects.

The present invention has the advantage of providing a planar heating element capable of allowing electric current to evenly flow across a whole plane by using two or more wires having different thicknesses and materials, thereby evenly generating heat. As a result, according to the present invention, provided is a metal planar heating element which is not overloaded and not burned out by means of fine control of electric current.

Further, a planar heating element according to the present invention uses a wire consisting of STS. As a result, according to the present invention, provided is a metal planar heating element capable of ensuring excellent flexibility, weight lightening, corrosion resistance and durability.

BRIEF DESCRIPTION OF THE INVENTION

1. First wire part
2. Second wire part
3. Module part

BEST MODE FOR CARRYING OUT THE INVENTION

Details including the above-described technical problems, the technical solutions of the present invention and the advantageous effects of the present invention are included in the embodiments and drawings that will be described hereunder. Advantages and features of the present invention, and a method for obtaining the advantages and features will become apparent from the embodiments that will be described in detail with reference to the drawings.

Figure 1:
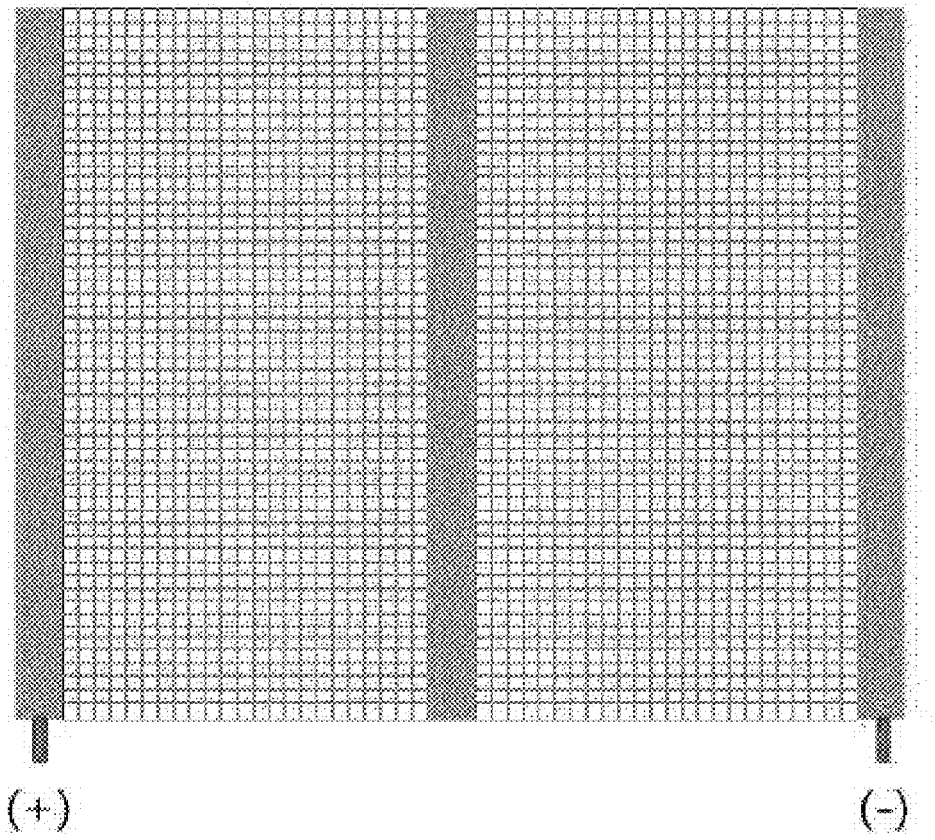
FIG. 1 Prior Art
FIG. 1 is a view illustrating a conventional planar heating element.
Figure 2:
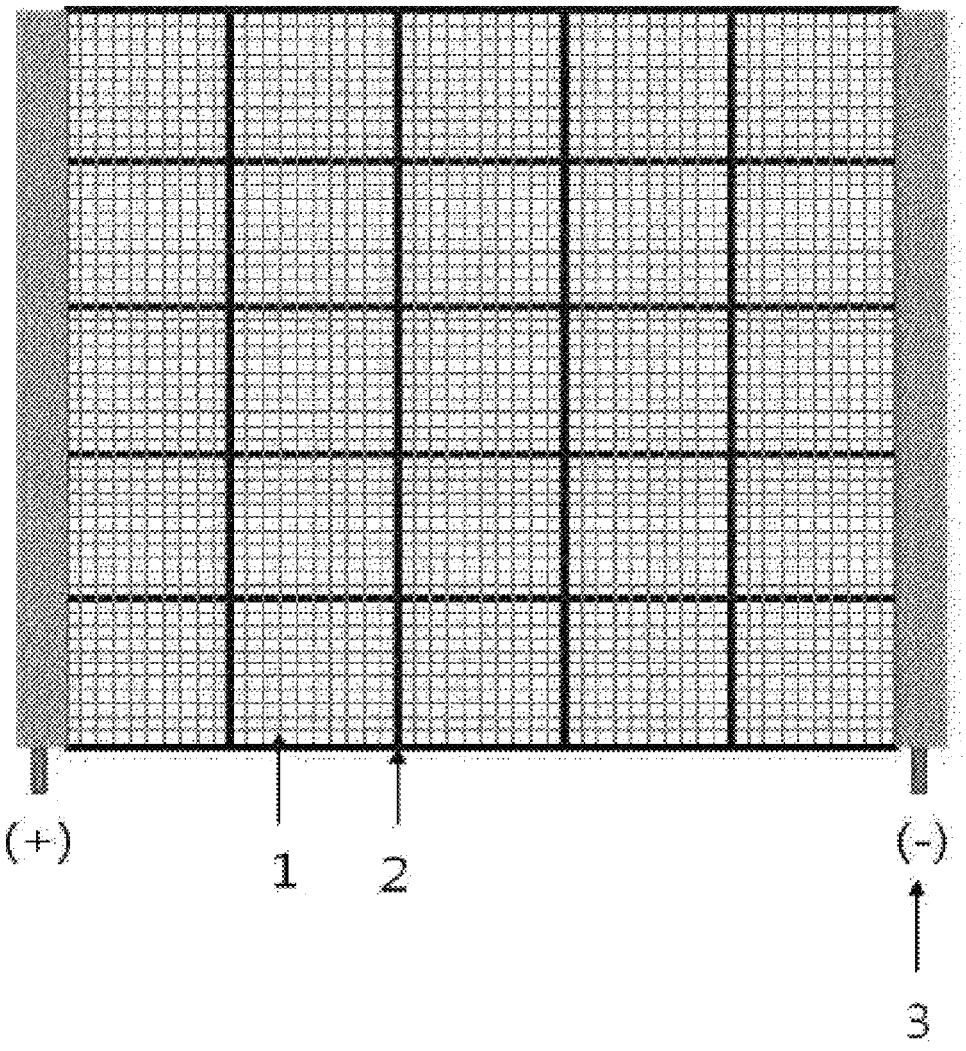
FIG. 2 is a view illustrating a planar heating element according to the present invention.

As illustrated in FIG. 2, a planar heating element of the present invention includes a first wire part 1 which has a mesh structure, a second wire part 2 which is woven and configured to have a mesh size relatively larger than that of the first wire part 1; and a module part 3 which is connected to the first wire part 1 or the second wire part 2 to supply power.

First, a planar heating element of the present invention is provided with a first wire part 1. As illustrated in FIG. 2, the first wire part 1 is configured to have a mesh shape in which warps and wefts are provided and woven.

The first wire part 1 receives power and lets a planar heating element of the present invention generate heat.

Wires consisting of the first wire part 1 may be formed from any material for the above-described function, and materials used for metal heat wires or materials used for heat wires, in which electrically conductive heat wires are coated with or extruded from synthetic resins, may be used for the wires.

For instance, STS which has excellent weight lightening, corrosion resistance, flexibility and durability may be used as a material for the first wire part 1.

The STS is steel in which a significant amount of chromium (in general, more than or equal to 12%) is contained in iron (Fe) so as to prevent rust, and may be ally steel in which a small amount of carbon (C), nickel (Ni), silicon (Si), manganese (Mn), molybdenum (Mo) etc. are compounded in the STS depending on the needs.

The first wire part 1 may distribute electric current across a whole plane by means of controlled density of the mesh structure. Next, a planar heat element of the present invention is provided with a second wire part 2.

As illustrated in FIG. 2, the second wire part 2 is connected with a part of the first wire part 1 and has a mesh structure relatively larger than that of the first wire part 1. The second wire part 2 may be designed in various ways. For instance, the second wire part 2 may be woven from wires of the second wire part 2, which substitute for some wires of the first wire part 1, or the second wire part 2 is separately attached to the first wire part 1.

The second wire part 2 is configured to have lower electric resistance than the first wire part 1 such that electric current may swiftly flow through the second wire part 2 and may be delivered to the first wire part 1, thereby evenly generating heat as a whole.

To control electric resistance, a material with low electric resistance may be used for wires consisting of the second wire part 2, or thickness (width) of the wires may change while the same material is used for the wires.

In the event that different materials are used for the wires as a means to control electric resistance, the second wire part 2 uses conductive wires to let electric current swiftly flow as a whole. For instance, if the first wire part 1 consists of STS wires, the second wire part 2 may consist of conductive wires consisting of materials with low electric resistance such as copper, nickel etc.

Copper has high heat and electric conductivity and a high elongation value, and therefore may be micro-machined. Nickel has high ductility and malleability. Accordingly, different materials may be used according to purposes the planar heating element serves considering the features of the conductive wires.

Contrary to STS consisting of the first wire part 1, conductive wires consisting of materials with a low electric resistance coefficient such as copper, nickel etc., are used for the second wire part 2 to let electric current swiftly flow, thereby evenly generating heat as a whole.

The second wire part 2 enables electric current to swiftly flow thereby evenly generating heat as a whole. At the same time, if a heating material is used for the second wire part 2, the second wire part 2 may serve as a heating element.

In another way, in the event that thickness (width) of the wires consisting of the second wire part 2 is larger than that of the wires consisting of the first wire part 1, electric current may swiftly flow thereby evenly generating heat as a whole.

The module part 3 is configured to include an electrode member, and a power connecting terminal etc. is attached to the electrode member. The module part 3 is provided at one side of the first wire part 1 and the second wire part 2 and supplies power to let electric current flow.

The configuration of the module part 3 may be modified in various ways according to the purposes pursued by sectors related to clothing, heating devices, home appliances, livestock facilities, to which a planar heating element is applied. Further, a planar heating element of the present invention may further include an insulation configuration, and the insulation configuration may be modified in various ways according to use of a planar heating element.

Below, operations of the present invention with the above-described configuration will be described.

First, power is supplied to a planar heating element according to the present invention. When power is supplied, electric current flows through an electrode member of the module part 3.

The electric current is swiftly delivered through one side of wires of the second wire part 2 which is connected with one side of the module part 3 and has low electric resistance, and the electric current delivered through one side of the wires of the second wire part 2 is delivered to the whole second wire part 2. If the second wire part 2 consists of a material capable of generating heat, electric current flows and at the same time, heat is generated at the second wire part.

The electric current delivered to the whole second wire part 2 is delivered to the whole first wire part 1 through one side of the first wire part 1 connected with the second wire part 2. When the electric current is delivered, electric current flows and at the same time, heat is generated at the first wire part 1. Accordingly, the first wire part 1 serves as a planar heating element.

It is to be understood that those skilled in the art to which the present invention pertains may embody the above-described technical configuration of the present invention in various different forms without departing from the spirit and features of the present invention.

Therefore, it should be understood that the above-described embodiments have been provided as examples and the present invention should not be construed as being limited to the embodiments set forth herein. Further, the scope of the present invention should be determined only by the attached claims rather than the above-described detailed description, and all modifications and modified forms drawn from the meaning and scope of the appended claims and the equivalent concept thereof should be construed as being included in the scope of the present invention.

The invention claimed is:

1. A planar heating element comprising:

a first wire part which generates heat when power is supplied and which is woven by warps and wefts to form a mesh structure;

a second wire part which is woven together with the first wire part by wires substituting parts of the warps and wefts of the first wire, electrically connected with the first wire part at a plurality of points, and generates heat when power is supplied and which has a mesh structure having a unit area larger than that of the first wire part; and an electrode member, being electrically connected with the first wire part and the second wire part, and supplying power to the first wire part and the second wire part, wherein the planar heating element woven by the first wire part and the second wire part includes a first edge and a second edge opposite to the first edge, and wherein the electrode member includes:

a first electrode connected to the first wire part and the second wire part at the first edge of the planar heating element; and a second electrode connected to the first wire part and the second wire part at the second edge of the planar heating element.

2. The planar heating element according to claim 1, wherein the first wire part is formed from a material with an electric resistance coefficient higher than that of a material of the second wire part.

3. The planar heating element according to claim 2, wherein:

the first wire part is formed from stainless steel (STS), and the second wire part is formed from a conductive material comprising at least one of STS, copper, nickel.

4. The planar heating element according to claim 1, wherein the first wire part has a thickness and pattern different from those of the second wire part.

* * * * *